US005213819A

United States Patent [19]

Bielfeldt

[11] Patent Number: 5,213,819

[45] Date of Patent: May 25, 1993

[54] CONTINUOUSLY OPERATING PRESS

[75] Inventor: Friedrich B. Bielfeldt, Eppingen, Fed. Rep. of Germany

[73] Assignee: Maschinenfabrik, J. Dieffenbacher GmbH & Co., Eppingen, Fed. Rep. of Germany

[21] Appl. No.: 845,936

[22] Filed: Mar. 6, 1992

Related U.S. Application Data

[63] Continuation-in-part of Ser. No. 732,197, Jul. 19, 1991, abandoned, which is a continuation-in-part of Ser. No. 671,403, Mar. 19, 1991, Pat. No. 5,096,408.

[30] Foreign Application Priority Data

Mar. 30, 1990 [DE] Fed. Rep. of Germany ..... 4010308
Mar. 12, 1991 [DE] Fed. Rep. of Germany ..... 4107833

[51] Int. Cl.[5] ..... B30B 5/04
[52] U.S. Cl. ..... 425/371; 100/93 RP; 156/583.4; 156/583.5
[58] Field of Search ..... 100/93 RP, 153, 154; 156/555, 583.4, 583.5; 425/371

[56] References Cited

U.S. PATENT DOCUMENTS

| | | | |
|---|---|---|---|
| 4,406,719 | 9/1983 | Mitsumoto et al. | 156/583.5 |
| 4,485,733 | 12/1984 | Held | 425/371 |
| 4,560,431 | 12/1985 | Inselmann | 156/555 |
| 4,699,676 | 10/1987 | Held | 156/583.5 |
| 4,771,683 | 9/1988 | Schermutzki | 156/583.5 |
| 4,921,418 | 5/1990 | Bielfeldt | 156/583.5 |
| 5,042,372 | 8/1991 | Bielfeldt et al. | 425/371 |
| 5,098,514 | 3/1992 | Held | 156/583.5 |

FOREIGN PATENT DOCUMENTS

| | | | |
|---|---|---|---|
| 2320178 | 10/1974 | Fed. Rep. of Germany | 425/371 |
| 2343427 | 3/1975 | Fed. Rep. of Germany . | |
| 3743933 | 12/1987 | Fed. Rep. of Germany . | |
| 3802296 | 8/1989 | Fed. Rep. of Germany | 425/371 |

*Primary Examiner*—Jay H. Woo
*Assistant Examiner*—Scott Bushey
*Attorney, Agent, or Firm*—Foley & Lardner

[57] ABSTRACT

A continuously operating press includes a press table, a press ram facing the press table, first and second flexible endless steel bands which transfer a pressing pressure to and draw a material to be pressed through an adjustable pressing gap, and driving drums and deflecting drums which drive the first and second endless steel bands around the press table and the press ram, respectively. Rolling bars are disposed with their axes being transverse to the running direction of the steel bands and extending over the entire working area of the press. Heated platens are attached to the press table and press ram, respectively, with the rolling bars rolling on the heated platens. The heated platens have end surfaces which are connected to one another via straight butt joints. The heated platens also have bore holes formed therein which extend parallel to the longitudinal direction of the press and which are independently heatable to provide a plurality of heating surfaces in each of the heated platens. Roll platens at least partially cover the heated platens and extend over the entire working area of the press. The roll platens have a thickness in a range of 7 mm to 23 mm and a Brinell hardness of 250, are heat treated on opposite surfaces, and have a precision ground finish. Finally, expansion joints join the roll platens and extend obliquely relative to the running direction of the steel bands.

11 Claims, 5 Drawing Sheets

CONTINUOUSLY OPERATING PRESS

CROSS REFERENCE TO RELATED APPLICATIONS

This application is a continuation-in-part of U.S. application Ser. No. 07/732,197, filed Jul. 19, 1991, abandoned, which is a continuation-in-part of U.S. application Ser. No. 07/671,403, filed on Mar. 19, 1991, now U.S. Pat. No. 5,096,408.

BACKGROUND OF THE INVENTION

1. Field of the Invention

The invention relates to a continuously operating press for the production of chipboards, fiberboards and plywood boards.

2. Description of the Related Art

In the case of presses operating in the high-pressure range, development is moving toward exerting higher surface pressures on the material being pressed. This is especially true if the purpose is to produce highly compressed chipboards, where the pressures range from 55 bar and above. With rolling support provided by means of rolling bars, these high pressures increasingly result in "Hertzian stresses" on the surfaces of the heated platens. On the other hand, the heated platens have to be produced from a weldable steel material, because it is necessary to weld in inserts appropriately at the deflection channels and generally seals at the outer end faces. Weldable steels have, however, only a limited carbon content, which normally results in a surface hardness of about 180 to 190 Brinell. Additional surface hardness treatments merely produce an increased Brinell hardness in the range from 200 to 220 Brinell. With the large dimensions of the heated platens (for example 2.5 m×10 to 15 m long), there is a thermal distortion which occurs during the course of the heat treatment for increasing hardness. Thus, there is a risk in such heat treatment processes that, if the heated platens are not rolled with a level surface area, the relatively thin hardened layer is removed in the subsequent grinding machining processes, thereby penetrating and exposing layers of lesser Brinell hardness.

In the practical operation of continuous presses using such heated platens, the above-stated condition has the effect that considerable wear occurs on the heated platens' supporting surfaces after operating hours of about 3000 to 6000 hours. This wear does not result so much in a general removal of the supporting surface, but instead, grooves (with peak and valley) are formed transversely to the through-running direction of the material to be pressed. These grooves correspond approximately to the spacing of the rolling bars. This results in increased running noises, and with increasing wear, produces critical vibrations in the overall press system. At a surface pressure of 50 bar, the "Hertzian stress" with use of rolling bars (in the diameter range around 20 mm) lies at about 200 Brinell. Thus, with the slightest disturbances, for example, in a regular and uniform lubrication distribution system, the system operates unreliably as a result of which the wear phenomena described above occur.

It is of disadvantageous significance in this case that the orthogonal running of the rolling bars in the pressing area is not ensured and that it is possible for the rolling bars to run into each other and even be destroyed.

From DE-P 23 43 427, a press of the aforementioned type is known, wherein several pressure bodies (abutments of press ram and platen) are located in succession in the direction of passage and between the pressure bodies and the rolling body chain, stationary, elastically bending roll off surfaces are provided. The rolling body chain consists of numerous small rollers, threaded onto rods extending over the width of the press. Between the individual rollers, located on rods off-set relative to each other in the longitudinal and transverse direction, straps are provided to connect with the subsequent rods. The elastically bending roll off surfaces consist of a plurality of strips of a precision flat rolled steel, in the longitudinal joints of which the noses of the straps of the rolling body chain are guided.

The purpose of the strip roll off surfaces is to bridge over the numerous roller bodies to insure the avoidance of pressure peaks which appear in the case of different press masses in the entering wedge and which could damage the steel belts and the roller bodies.

This known press and sizing apparatus cannot assure that the rollers will move in an optimum manner and without friction through the press gap without hindrance since the numerous strap noses grind against the longitudinal joints and the lateral surfaces of the roll off strips, thereby considerably reducing the advantage of the rolling support. In addition, the roll off strips would also be exposed to the aforedescribed wear after a few hours of operation and exhibit a certain corrugation harmful to the operation of the press.

Heating platen systems are known from German published patent Application DE 37 43 933, wherein heating zones are formed by means of longitudinal bore holes transversely to the direction of transport of the material to be pressed, whereby a difference in temperature profiles may be established. Thus, for example by raising the temperature in the center of the heated platen, better vaporization is obtained due to the higher vapor pressure from the inside to the outside, together with a purposely centered heat supply into the material to be pressed, in the production of narrower particle boards. In the course of the conversion from wide particle boards to smaller ones, energy consumption will be lower and the dish effect of the steel band resulting from differential thermal expansion may be equalized.

However, the heated platens simultaneously also constitute the rolling support of the rolling bars. In view of this, the transitions have corresponding toothed configurations. The transitions forming the three heated platens are laid out appropriately with thermal expansion gaps. This leads for the rolling bars to partially increased surface pressures in the transition range from one heated platen to the other, whereby in particular in the high pressure range the permissible specific surface pressure for the compression of the particle cake is further minimized, so that within this area partial transmission pressures of merely about 30 bars are permissible. Technologically, however, pressures of up to 50 bars are required. Due to the fan-shaped zigzag transitions in the transition range, very high production costs are encountered in the preparation for the installation of connections of the longitudinally drilled heated platens. The purpose and function of the longitudinally drilled heated platens according to DE 37 43 933 is to be able to produce narrower particle boards by means of the directed and centered supply of heat. This would also enable the exploitation of the advantage of using higher compression pressures for boards with higher (scatter)

densities in view of the narrower width. However, this cannot be realized by reason of the limited permissible specific pressures. In actual operation with continuous presses, the use of such heated platens results in that, after a number operating units totalling about 3000 to 6000 hours, a marked wear of the support surfaces is encountered. This wear leads not so much to a general erosion of the supporting surface but more to the formation, in the direction of the passage, of transverse grooves generally corresponding to the spacing of the rolling bars (with valleys and peaks). In combination with this, increasingly loud running noises appear, which with progressive wear lead to critical variations of the overall press system.

OBJECTS AND SUMMARY OF THE INVENTION

It is an object of the invention to further develop a continuously operating press of the above-mentioned type so that the disadvantages described above do not occur, the wear of the heated plates or platens is avoided and the safe orthogonal roll-off of the rolling bars is assured.

This objective is achieved by a continuously operating press which has a press table and a press ram with an adjustable gap defined therebetween. The press also has driving and deflecting drums which drive endless flexible steel bands around the press ram and press table respectively. The steel bands are supported by rolling bars disposed between the press table and press ram. The rolling bars extend over the entire width of the press area with their axes extending transverse to the movement of the steel bands. The rolling bars roll on roll platens which have a thickness in a range of 7 mm to 22 mm and a Brinell hardness of 250. The roll platens have heat-treated precision ground finished surfaces, at least partially cover the surfaces of the heated platens which are in turn attached to the press table and press ram, and extend over the entire working area of the press. Expansion joints join the roll platens and extend obliquely to the running direction of the steel bands.

The configuration according to the invention of the continuously operating press makes it possible to provide roll off plates or roll platens made of a steel having a higher carbon content and thus heat treatable to Brinell hardnesses of 250 and higher. The roll platens according to the invention are heat-treated on both sides and may be through hardened and are surface treated on both sides to minimize the rolling resistance of the rolling bars, for example by superfinishing. The higher surface hardness of these roll platens provides an ideal rolling support for the rolling bars themselves. As there is no wear on the surface, as occurs in the case of a direct support on the heated platens, a higher life expectancy of the rolling bars themselves may be expected.

The design according to the invention of the continuously operating press makes it possible to make roll platens from a steel having a higher carbon content, and which have a greater resistance to thermal distortion caused by heat treatment, and a Brinell hardness of 250 and above.

According to the invention, the roll platens are heat-treated on both sides or may be hardened-throughout. The surface is treated, for example, by precision grinding on both sides to minimize the rolling resistance of the rolling bars. The increased surface hardness of these roll platens provides an ideal rolling support for the rolling bars. Since no wear occurs on the roll platen surfaces, as in the case of support directly against the heated platens, a higher life expectancy of the rolling bars themselves is also likely. The perfectly satisfactory rolling of the rolling bars on the roll platen also helps to achieve an exact running control of the steel band. The effect of the rolling bars on the roll platen also helps to achieve an exact running control of the steel band. Due to the effect of the hydraulic compressive forces produced by the centrally arranged multipot cylinders during the control for setting a chip-board of parallel thickness, a topographically increased surface peak pressures in the range of up to about 250 bar may occur. Only with these hardened roll platens is the press system able to accommodate these increased pressures and continue to function properly and produce an advantageous cost-effective service life. With regard to quality, service life, producibility and installability, a thickness of 7 to 23 mm is regarded as being advantageous for the roll platens. However, for optimization of requirements, a thickness of 12 to 18 mm is recommended.

It is another object of the invention to further develop the press according to the basic device discussed above so that:

a differential temperature profile may be established with a higher temperature in the longitudinal center of the pressing surface;

no increased production costs are generated in the manufacture of longitudinally drilled heated platens; and the advantages provided by the basic device is fully preserved.

This object is obtained by providing a continuously operating press comprising a press table, a press ram facing the press table and defining an adjustable pressing gap therebetween, first and second flexible endless steel bands which transfer a pressing pressure to and draw a material to be pressed through the adjustable gap, and driving drums and deflecting drums which drive the first and second endless steel bands around the press table and the press ram, respectively. Rolling bars support the endless steel bands and move with the endless steel bands. The rolling bars are disposed with their axes being transverse to the running direction of the steel bands and extending over the entire working area of the press. Heated platens are attached to the press table and press ram, respectively, with the rolling bars rolling on the heated platens. The heated platens have end surfaces which are connected to one another via straight butt joints. The heated platens also have bore holes formed therein which extend parallel to the longitudinal direction of the press and which are independently heatable to provide a plurality of heating surfaces in each of the heated platens. Roll platens at least partially cover the heated platens and extend over the entire working area of the press. The roll platens have a thickness in a range of 7 mm to 23 mm and a Brinell hardness of 250, are heat treated on opposite surfaces, and have a precision ground finish. Finally, expansion joints join the roll platens and extend obliquely relative to the running direction of the steel bands.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The press according to the invention is defined in detail using an illustrative embodiment and with reference to the drawing, in which.

DETAILED DESCRIPTION OF THE PREFERRED EMBODIMENTS

Figure 1:
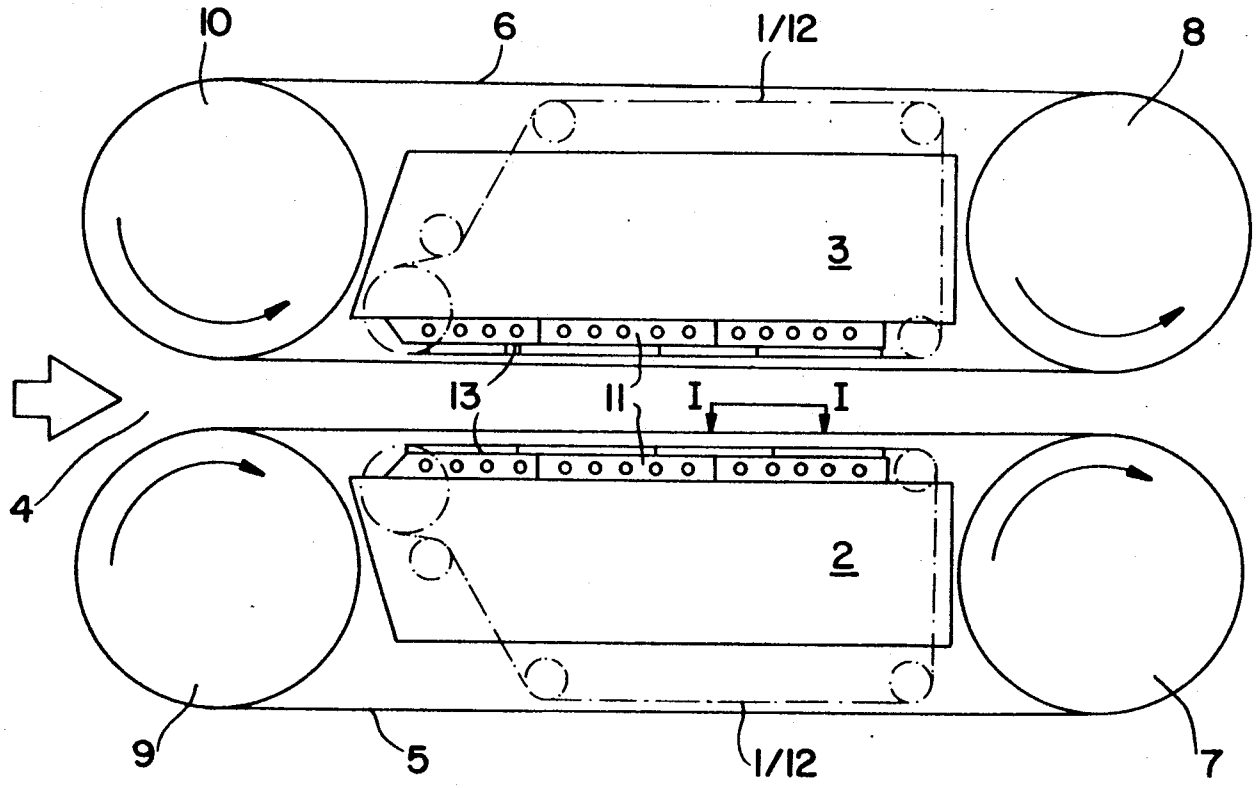
FIG. 1 shows in diagrammatic representation the continuously operating press in side view.

According to FIG. 1, the continuously operating press consists of a press table 2, a movable press ram 3 and tie bars (not shown) which connect them. For setting the pressing gap 4, the press ram 3 is moved up and down by hydraulic piston-cylinder arrangements (not shown) and arrested or held in the chosen position. Steel bands 5 and 6 are led around press table 2 and press ram 3, respectively, via driving drums 7 and 8 and deflecting drums 9 and 10. To reduce friction between the heated platens 11, which are attached to the press table 2 and press ram 3, and the circulating steel bands 5 and 6, there is provided, in each case, a rotating roller bar carpet formed by rolling bars 1. The rolling bars 1, the axes of which extend transversely to the band through-running direction, are locked together on the two longitudinal sides of the press in guide chains 12 of a predetermined pitch and are passed through the press by the steel bands. The rolling bars 1 roll on the heated platens 11 of press ram 3 and press table 2 and on the steel bands 5 and 6.

Since a high pressing force will be transferred to a material to be pressed which is running through the press, the rolling bars 1 are subjected to considerable stress. Consequently, one of the prerequisites for a trouble free operation of the press is that linear displacements of the rolling bars 1 in the pressing area cannot cause destruction of the guide chains 12 and the rolling bars 1 themselves. A prerequisite for not having a linear displacement of the rolling bars 1 in the pressing area which is too large, includes having a precisely orthogonal introduction of the rolling bars 1 in the run-in arc at the tangential transition to the horizontal pressing plane and a trouble-free running on the pressing surface.

Figure 2:
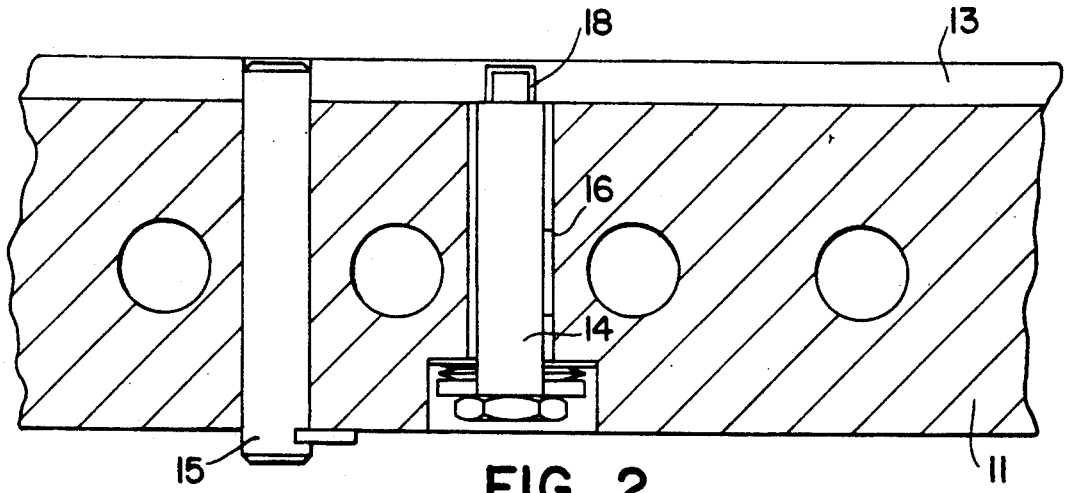
FIG. 2 shows a section of the heat platen and roll platen as viewed through section I—I of FIG. 1.
Figure 3:
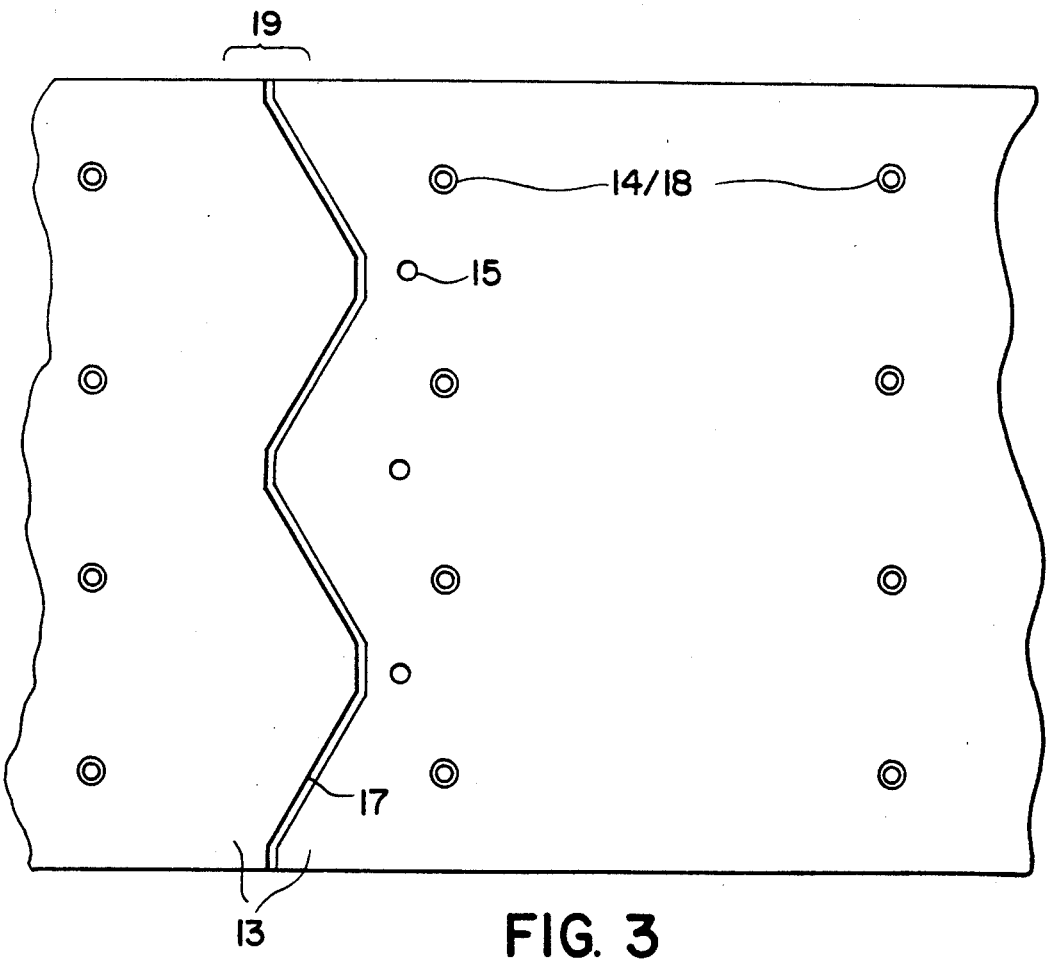
FIG. 3 shows a plan view of two roll platens according to FIG. 2.

FIGS. 2 and 3 show a section I—I from FIG. 1, which illustrates the attachment of the roll platens 13 to the heated platen 11 of the press table 2. The roll platens or roll off plates 13 are bolted against the heated platen 11 by means of a screw connection consisting of a screw bolt 14 and a threaded bore 18. The roll platens extend over the entire working area of the press. Thermal expansion is allowed for by having corresponding bores 16 in the heated platens 11 which have a greater diameter than the screw bolts 14. The threaded bores 18 are locate in the roll platens 13. At the end of the platens 13 which is nearer to where the material to be pressed enters, the roll platens 13 are fastened to the heated platens 11 by fixing bolts 15 as a fixed point. The transition from one roll platen 13 to the other are designed as sawtooth connections 19 and may be executed as trapezoidal or round arcs. Expansion joints 17 are provided between the roll platens and extend obliquely relative to the running direction of the steel bands as compensation to allow for thermal expansion. The bores in the heated platens 11 and roll platens 13 for the screw bolts 14 and fixing bolts 15 are, in this case, arranged in such a way that the roll platens can be turned so that both sides can be used as a running surface for the rolling bars 1. The roll platens can consequently remain in use for longer periods of time and the complete system can continue in operation for longer periods of time without requiring maintenance and repair. The roll platens 13 are dimensioned to allow them to be handled so that a plurality of interchangeable roll platen sections can be installed over the overall length of the heated platens. For example, 7 sections each having a length of 4 m could be used in the case of a heated platen having a length of 28 m.

Figure 4:
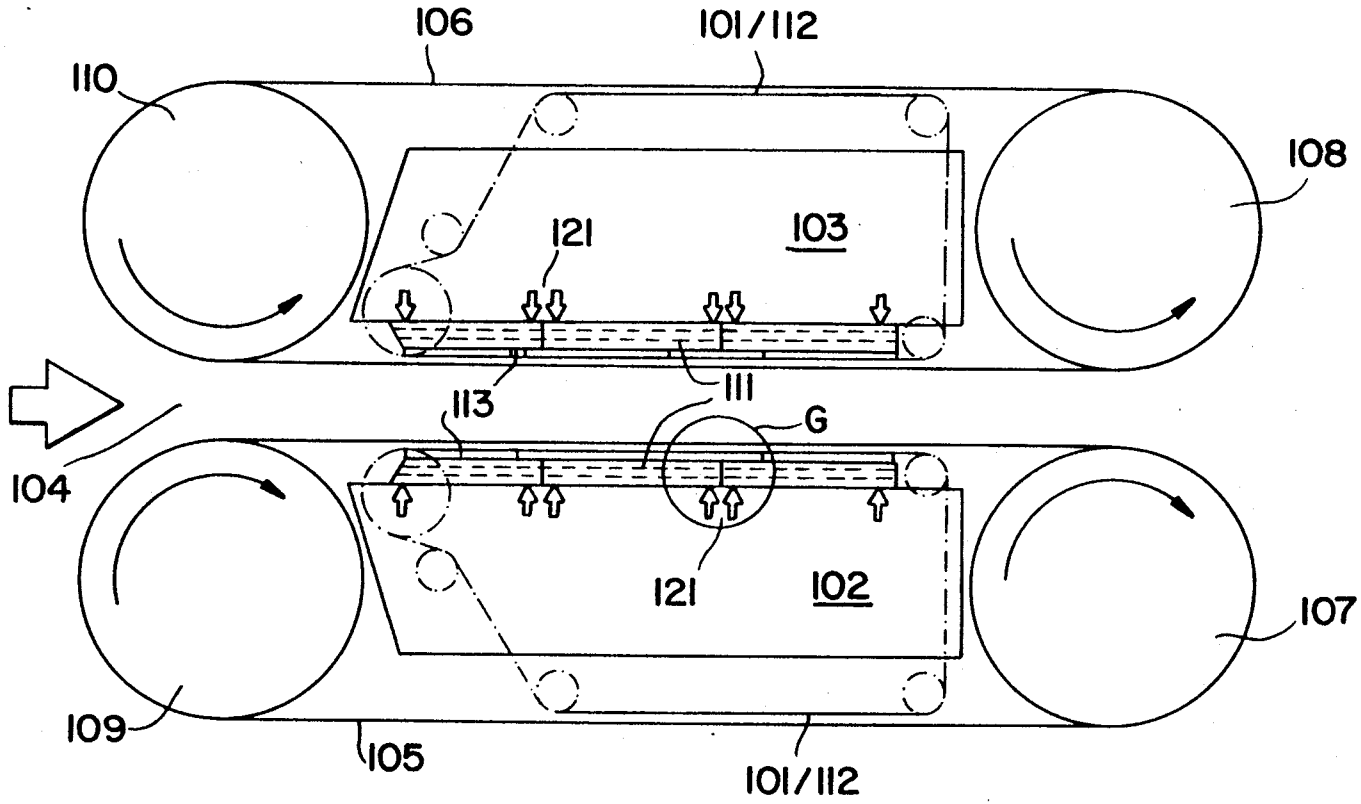
FIG. 4 shows a continuously operating press, schematically in a lateral elevation, construction in accordance with the second embodiment of the invention.

According to FIG. 4, the continuously operating press of the second embodiment of the invention consists of the press table 102, the movable press ram 103 and the lifting columns (not shown) connecting them. To set the press gap 104, the ram 103 is moved up and down by hydraulic piston-cylinder arrangements (not shown) and retained in the position chosen. The steel bands 105 and 106 are passed over drive drums 107 and 108 and reversing drums 109 and 110 around the press table 102 and the press ram 103. To reduce the friction between the heated platens 111 mounted on the press table 102 and the ram 103 and the revolving steel bands 105 and 106, a revolving carpet of rolling bars 101 each is provided. The rolling bars 101, the axes of which extend transversely to the moving direction of the bands, are combined on both longitudinal sides of the press in guide chains 112 with a predetermined pitch dimension and are transported over the heated platens 111 of the ram 103 and the press table 102, while rolling off the steel bands 105 and 106 by said steel bands through the press.

Figure 5:
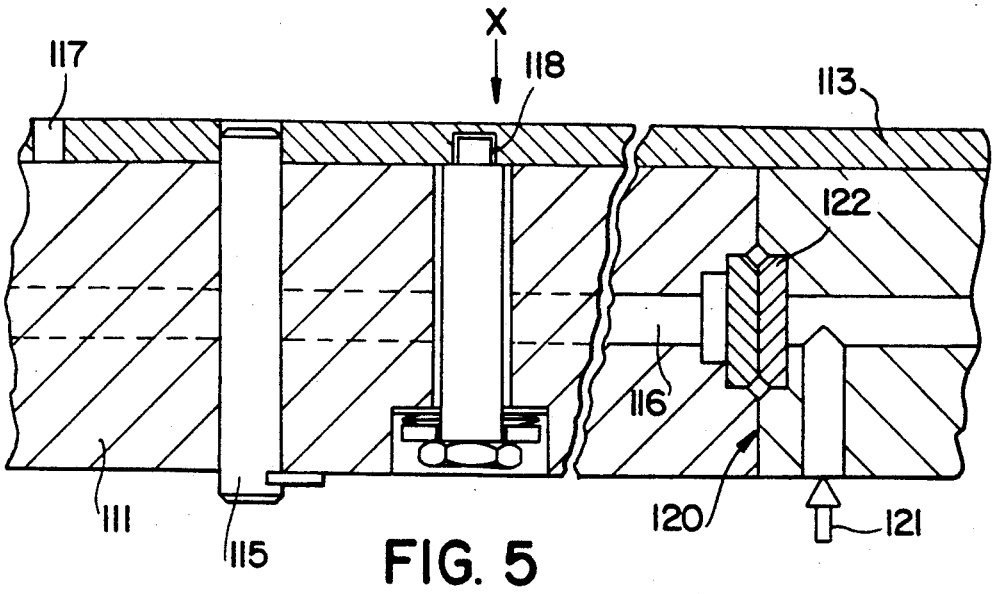
FIG. 5 shows a segment "G" of the press of FIG. 4.
Figure 6:
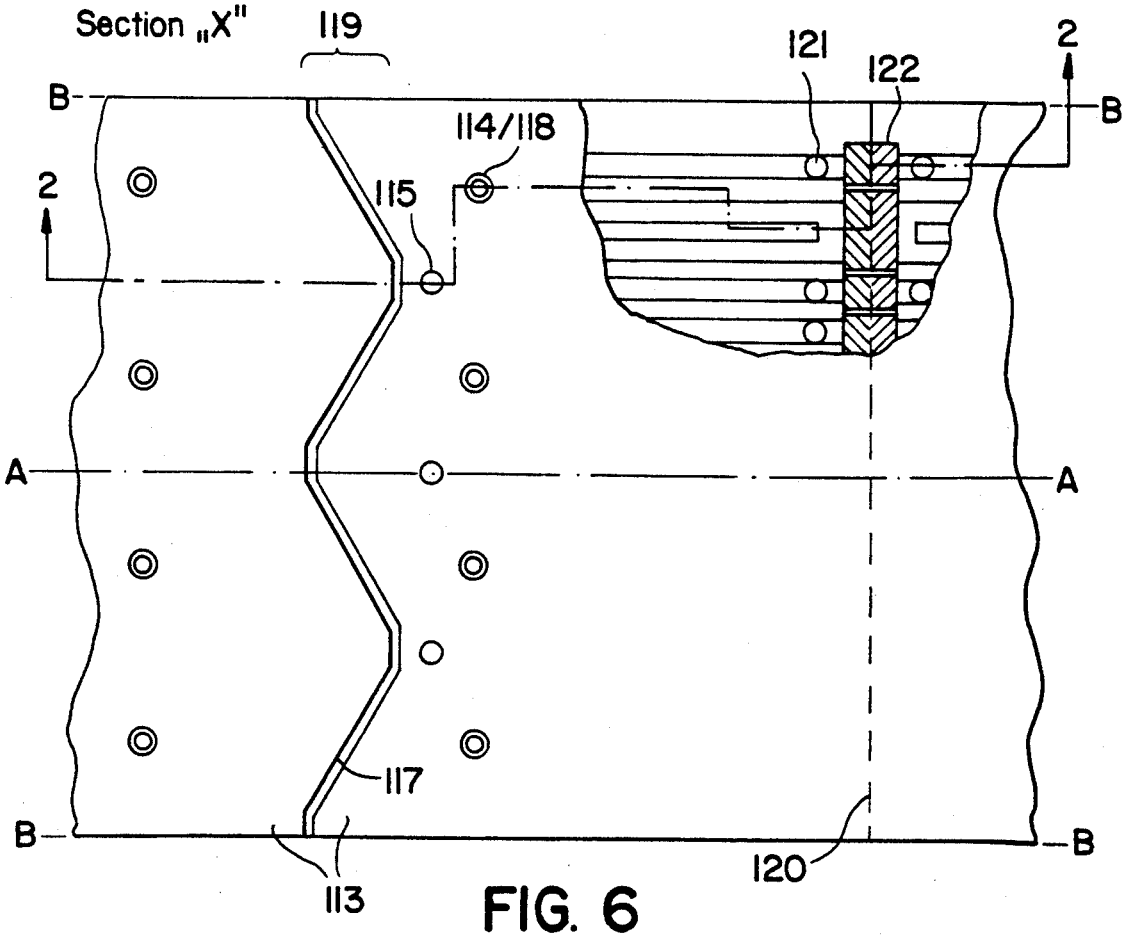
FIG. 6 shows a top elevation "X" of two rolling platens according to FIG. 5.

FIGS. 5 and 6 show, in 2—2 section, a segment 6 of FIG. 4, illustrating the mounting of the roll platens or roll-off plates 113 on the heated platens 111 of the press table 102. The roll-off plates 113 are fastened by means of screw connections 114 and 118 to the heated platens, and preferably have a thickness of between 7 mm and 23 mm and a Brinell hardness of 250. In the direction of passage, on the other hand, at the beginning, the roll-off plates 113 are fastened by means of locating bolts 115 as the fixed point to the heated platens 111. The transitions from one of the roll-off plates 113 to the other are in the form of sawtooth connections 119 and may have the configuration of trapezoidal or circular arcs, wherein an expansion gap 117 must be provided for thermal expansion equalization.

Figure 7:
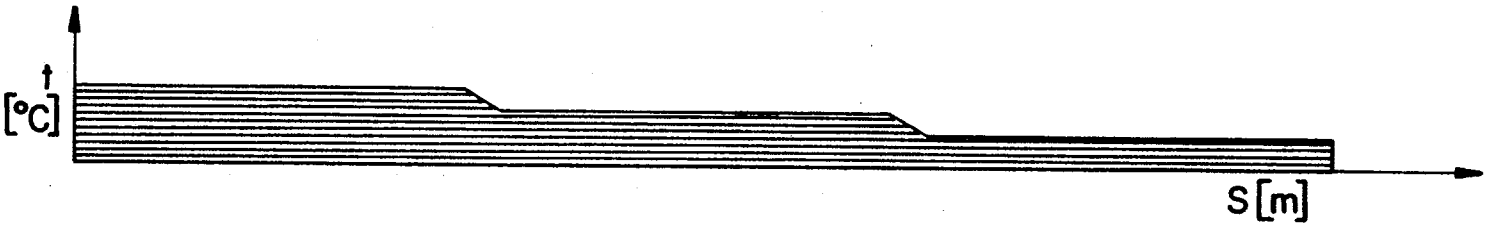
FIG. 7 is a temperature-time-path diagram with a temperature profile.
Figure 8:
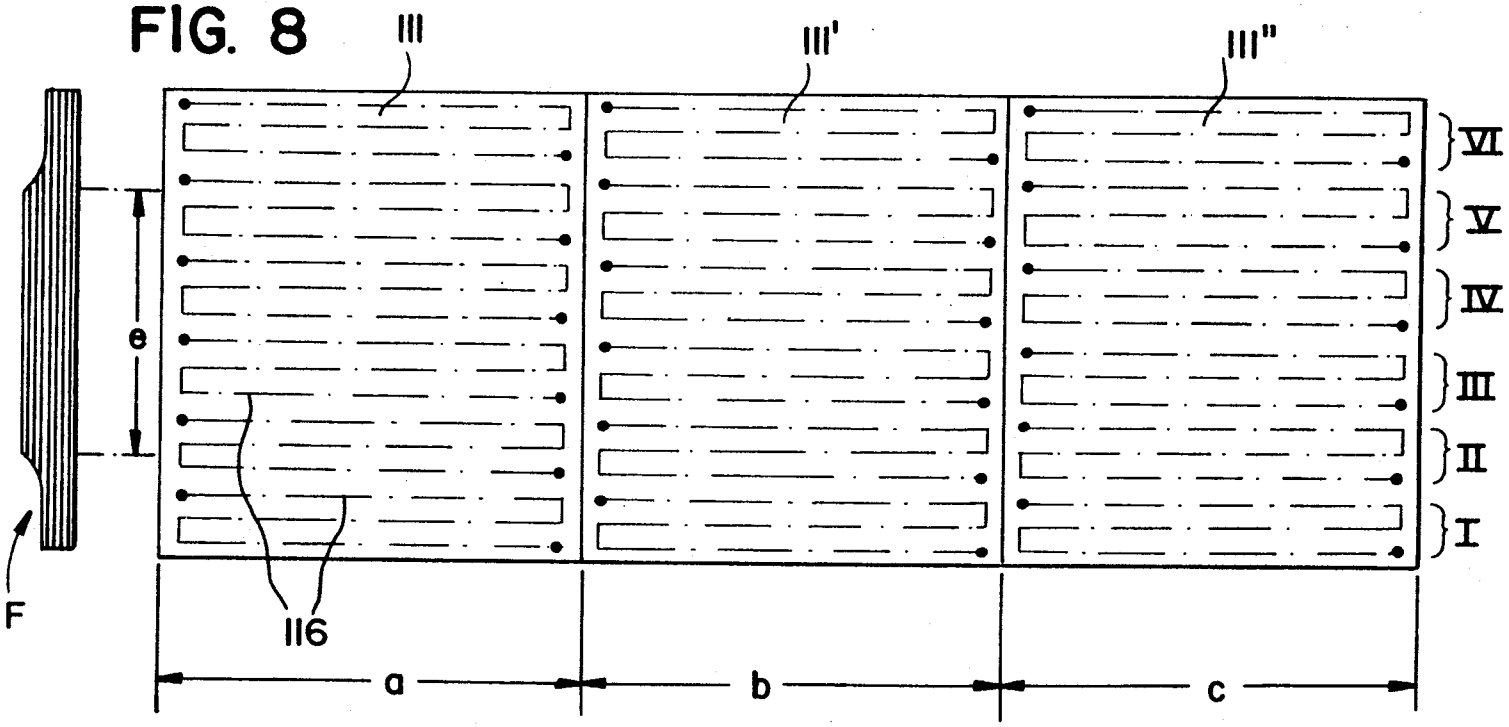
FIG. 8 shows the heating surface of the press table of FIG. 4 and the ram without the rolling platens.

FIGS. 7 and 8 show the press surface consisting of the heated platens 111 and the inlet, the heated platens 111' in the central part of the press and the heated platens 111" at the press outlet. As indicated in the temperature-time-path diagram of FIG. 7, the temperature profile is built up by the thermal energy impact in the heating zone a at the inlet, the declining temperature in the heating zone b and the heating zone c at the outlet at a lower temperature. In order to be able to establish a temperature profile transversely to the longitudinal direction of the heated platens, 111, 111' and 111'', or in the running direction of a continuously operating press, heat carrier bore holes 116 are located in the longitudinal direction of the heated platens as illustrated in FIG. 8, the heat platens carrier bore holes 116, arranged in the longitudinal direction, are divided in the transverse direction into different heating surfaces I to VI, i.e., each heating surface I to VI may be set differently, for example at a temperature level F. The symbol e designates the width of the material to be pressed.

By means of a hydraulic and/or electric control apparatus, the temperature level F may be regulated with the aid of temperature sensors at the heated platens 111, 111' and 111'' and a value depending on the width e of the material being pressed, by the addition or interconnection of individual heating surfaces I to VI, or by the introduction of heating media at different temperatures into the heat carrier bore holes 116 of the heated platens 111, i.e., a temperature profile P with increasing temperature may be realized from the longitudinal sides B—B to the longitudinal AA. The temperature is introduced to the heat carrier bore holes 116 arranged in the longitudinal direction of the press, in the heated platens 111, 111', 111'' by the feeder lines 121 on the side opposite to the steel bands 105 or 106, perpendicularly to the heat platen surface of this reverse side. In this manner the thermal energy required may be introduced purposefully only into the area of the width of the material being pressed, whereby as described above, band corrugations are prevented and thermal energy saved, as loss radiation energy is being lost.

According to the invention, the heated platens 111 located below and above the roll-off plates 113 may be present with a butt joint 120 between the individual heating zones a, b, c without a sawtooth connection. By means of the straight butt 120, as shown in particular in FIGS. 5 and 6, the heated platens 111 may be realized in a known manner relatively simply in the deflection 112 of the heating medium. The supply and discharge lines 121 are associated in a simple manner with the heating platens 111 perpendicularly from the outside at the edges of the butt surface of the platens 120. In combination with the roll-off plates 113, it is no longer necessary to join the heating platens 111 at the transitions, for example between a and b or b and c in the area of the butt edges 120, by welding, if no fan-shaped transitions are required. The temperature may be controlled in view of the smooth butt 120 much more exactly in the transition zone, as the transition area is significantly smaller, i.e., in summary, a more exact temperature control is provided in the transverse and longitudinal directions.

What is claimed is:

1. A continuously operating press comprising:

a press table;

a press ram facing said press table and defining an adjustable pressing gap therebetween;

first and second flexible endless steel bands which transfer a pressing pressure to and draw a material to be pressed through said adjustable gap;

driving drums and deflecting drums which drive said first and second endless steel bands around said press table and said press ram, respectively;

rolling bars which support said endless steel bands and which move with said endless steel bands, said rolling bars being disposed with their axes being transverse to the running direction of said steel bands and extending over the entire working area of said press;

heated platens attached to said press table and press ram, respectively, said rolling bars rolling on said heated platens, said heated platens having end surfaces which are connected to one another via straight butt joints, said heated platens having bore holes formed therein which extend parallel to the longitudinal direction of said press and which are independently heatable to provide a plurality of heating surfaces in each of said heated platens;

roll platens at least partially covering said heated platens and extending over the entire working area of said press, said roll platens having a thickness in a range of 7 mm to 23 mm and a Brinell hardness of 250, said roll platens being heat treated on opposite surfaces, said roll platen surfaces having a precision ground finish; and expansion joints joining said roll platens and extending obliquely relative to the running direction of said steel bands.

2. The continuously operating press as claimed in claim 1, wherein said roll platens have a thickness in the range of 12 to 18 mm.

3. The continuously operating press as claimed in claim 1, further comprising a sawtoothed expansion joint, and wherein a plurality of roll platens are arranged adjacent to each other and separated by said sawtoothed expansion joint.

4. The continuously operating press as claimed in claim 3, further comprising a screw connection which allows for thermal expansion and which anchors said roll platens to said heated platens.

5. The continuously operating press as claimed in claim 4, further comprising fixing bolts which firmly fasten said roll platens to said heated platens as a fixed point, said fixing bolts being located near an end of the roll platens which is nearest to where said material to be pressed enters said adjustable gap.

6. The continuously operating press as claimed in claim 1, further comprising a screw connection which allows for thermal expansion and which anchors said roll platens to said heated platens.

7. The continuously operating press as claimed in claim 1, further comprising fixing bolts which firmly fasten said roll platens to said heated platens as a fixed point, said fixing bolts being located near an end of the roll platens which is nearest to where said material to be pressed enters said adjustable gap.

8. The continuously operating press as claimed in claim 1, wherein said heating surfaces of each of said heated platens are heated to a temperature level which decreases from a central region surrounding a longitudinal center line of said press to longitudinal sides of said press, said temperature level in said central region of said press being substantially equal over a width which corresponds to the width of an article being pressed.

9. The continuously operating press as claimed in claim 1, wherein each of said heated platens has a pressing surface, said pressing surfaces of said heated platens being arranged in succession on said press table and said press ram and being divided into a plurality of heating zones, each of which is selectively supplied with different amounts of thermal energy.

10. The continuously operating press as claimed in claim 9, wherein longitudinal ends of said heating zones abut one another.

11. The continuously operating press as claimed in claim 8, wherein said heating surfaces have feeder and discharge openings formed therein which are provided at said butt joints and which accommodate heat-transfer media.

* * * * *